United States Patent [19]

Walters

[11] Patent Number: 4,952,095

[45] Date of Patent: Aug. 28, 1990

[54] SOFT BACKPACK FOR SCUBA DIVER AIR TANKS

[76] Inventor: William D. Walters, 2230 Biscay Ct., Byron, Calif. 94514

[21] Appl. No.: 284,124

[22] Filed: Dec. 14, 1988

[51] Int. Cl.[5] ..... B63C 11/02

[52] U.S. Cl. ..... 405/186; 441/106; 114/315

[58] Field of Search ..... 405/186; 441/106, 114, 441/115, 116; 114/315, 331

[56] References Cited

U.S. PATENT DOCUMENTS

| | | | |
|---|---|---|---|
| 3,014,448 | 12/1961 | Fogarty et al. | 114/315 X |
| 3,670,509 | 6/1972 | Walters | 114/315 X |
| 4,009,583 | 3/1977 | Buchele | 114/315 X |
| 4,016,616 | 4/1977 | Walters | 405/186 |
| 4,137,585 | 2/1979 | Wright | 441/116 X |
| 4,561,853 | 12/1985 | Faulconer et al. | 441/106 X |
| 4,694,772 | 9/1987 | Faulconer et al. | 441/116 X |
| 4,779,554 | 10/1988 | Courtney | 405/186 X |

FOREIGN PATENT DOCUMENTS

| | | | |
|---|---|---|---|
| WO86/02613 | 5/1986 | PCT Int'l Appl. | 405/186 |
| 2197627 | 5/1988 | United Kingdom | 441/106 |

*Primary Examiner*—Dennis L. Taylor
*Assistant Examiner*—Arlen L. Olsen
*Attorney, Agent, or Firm*—Bruce & McCoy

[57] ABSTRACT

A soft backpack for SCUBA diver air tanks wherein a bladder filled with fluid is secured to the driver's tank and disposed between the tank and the diver's body.

9 Claims, 3 Drawing Sheets

41

39

43

33
27
23
25
15
37
13
47
19
29
11
31
13
15

43

11

41

51
21
41
45
43

SOFT BACKPACK FOR SCUBA DIVER AIR TANKS

BACKGROUND OF THE INVENTION

1. Field of the Invention

The present invention relates to backpacks for SCUBA divers for mounting air tanks on the back of the diver during an underwater dive. More particularly, it relates to an improved backpack which is soft and of malleable construction in order to more comfortably cushion the weight and configuration of the air tank on the diver's back.

2. Description of the Prior Art

Backpacks for SCUBA diver air tanks are in most cases a rigid plastic board which can be strapped onto the back of a diver or secured to a diver's over garment such as a jacket or buoyancy compensator. A typical buoyancy compensator and air tank backpack are described in U.S. Pat. No. 4,694,772 for Diver's Buoyancy Compensator Belt, column 3, lines 15–29. The problem with the molded plastic backpack is that it is quite uncomfortable and can become particularly burdensome and tiring on extended dives.

Prior to the present invention, only cloth, fabric, metal, plastic, or a combination of the above materials have been utilized to make backpacks to hold SCUBA diver gas breathing tanks, hereafter called air tanks. The fabric and cloth backpacks experience four different types of problems. First, the tank can shift its position on the back of the diver due to stretch of the material or a poor fit or configuration of the backpack on the diver. The movement of the backpack can be very irritating or cause discomfort, particularly if it allows the tank to hit the diver's head, or if it allows the tank to roll from side to side on a diver's back throughout the duration of the dive. A second problem is that the padding, which is provided around the shoulders of the diver and the tank, can cause buoyancy problems and upward lift which are generally compounded as the thickness of the padding is increased for effectiveness and comfort. To counter the lift, the diver has to wear more lead on the weight belt to offset the buoyancy increase. This requires the diver to transport more weight to the dive site and to wear more weight underwater which is uncomfortable. The increase in discomfort is quite proportional to the increase in weight. Third, the variety of different shapes of divers' backs are a major problem to fit a universal backpack in order to provide a universally good fit. A diver's back can be long or short, wide or narrow, and the spine can be deeply curved or straight. In order to accommodate these various configurations, a fabric backpack will usually be loose on most divers at some location or another. Fourth, in these backpacks padded with foam rubber, an especially troublesome physical transformation occurs: the foam rubber compresses as the diver descends in the water. As the padding compresses, the fit of the backpack becomes looser. For example, at 33 feet of depth in water, typical foam rubber is compressed to one half its volume. The average dive is 60 feet and the compression of the foam rubber is considerably greater at that depth.

The metal, plastic, or rigid construction backpacks for holding SCUBA tanks likewise have problems of fit and comfort. Rigid backpacks do not fit the different shapes and diver back sizes for the same reasons. While fabric and cloth backpacks can be provided with padding which causes lift, rigid backpacks can eliminate lift but have a fixed configuration which is to some degree in all cases unpadded and uncomfortable. This can cause diver discomfort when tightening the tank to the necessary degree to prevent movement on his back, and there can be increased and considerable discomfort over the duration of a dive if the backpack can move or if it is so tight that it causes cramping of the body. Thus, a more comfortable backpack for SCUBA diver air tanks is required to permit relaxed, more pleasant, and extended dives.

SUMMARY OF THE INVENTION

The present invention is a soft backpack for SCUBA diver air tanks which utilizes a liquid-filled bladder having an air tank mount secured thereto. The air tank is secured to the bladder and a means is provided for securing the bladder to a SCUBA diver's back with the bladder disposed between his back and the air tank. The bladder can be provided with its own harness, or it can be secured to a jacket which would then be attached to a buoyancy compensator or it could be sewn directly into a buoyancy compensator.

OBJECTS OF THE INVENTION

It is therefore an important object of the present invention to provide a soft backpack for SCUBA diver air tanks.

It is another object of the present invention to provide a liquid-filled bladder which can be attached to a SCUBA diver air tank with the bladder secured to a diver's back between the tank and his back.

It is a further object of the present invention to provide a liquid-filled soft backpack for SCUBA divers in which the internal liquid can be varied in volume for comfort and load size.

It is yet another object of the present invention to provide a soft backpack for SCUBA divers which includes a liquid-filled bladder that can be mounted on the diver's back by means of straps or enclosed in a jacket which can then be secured to a buoyancy compensator or can be mounted directly in the buoyancy compensator for cushioning the air tanks secured to the diver's back.

It is still a further object of the present invention to provide a liquid filled bladder which can be attached to an existing backpack by a universal attaching means.

Other objects and advantages of the present invention will become apparent when the soft backpack of the present invention is considered in conjunction with the accompanying drawings.

DESCRIPTION OF THE DRAWINGS

FIG. 12 is a rear inside elevation of FIG. 1.

DESCRIPTION OF THE PREFERRED EMBODIMENT

Reference is made to the drawings for a description of the preferred embodiment of the present invention wherein like reference numbers represent like elements on corresponding views.

Figure 1:
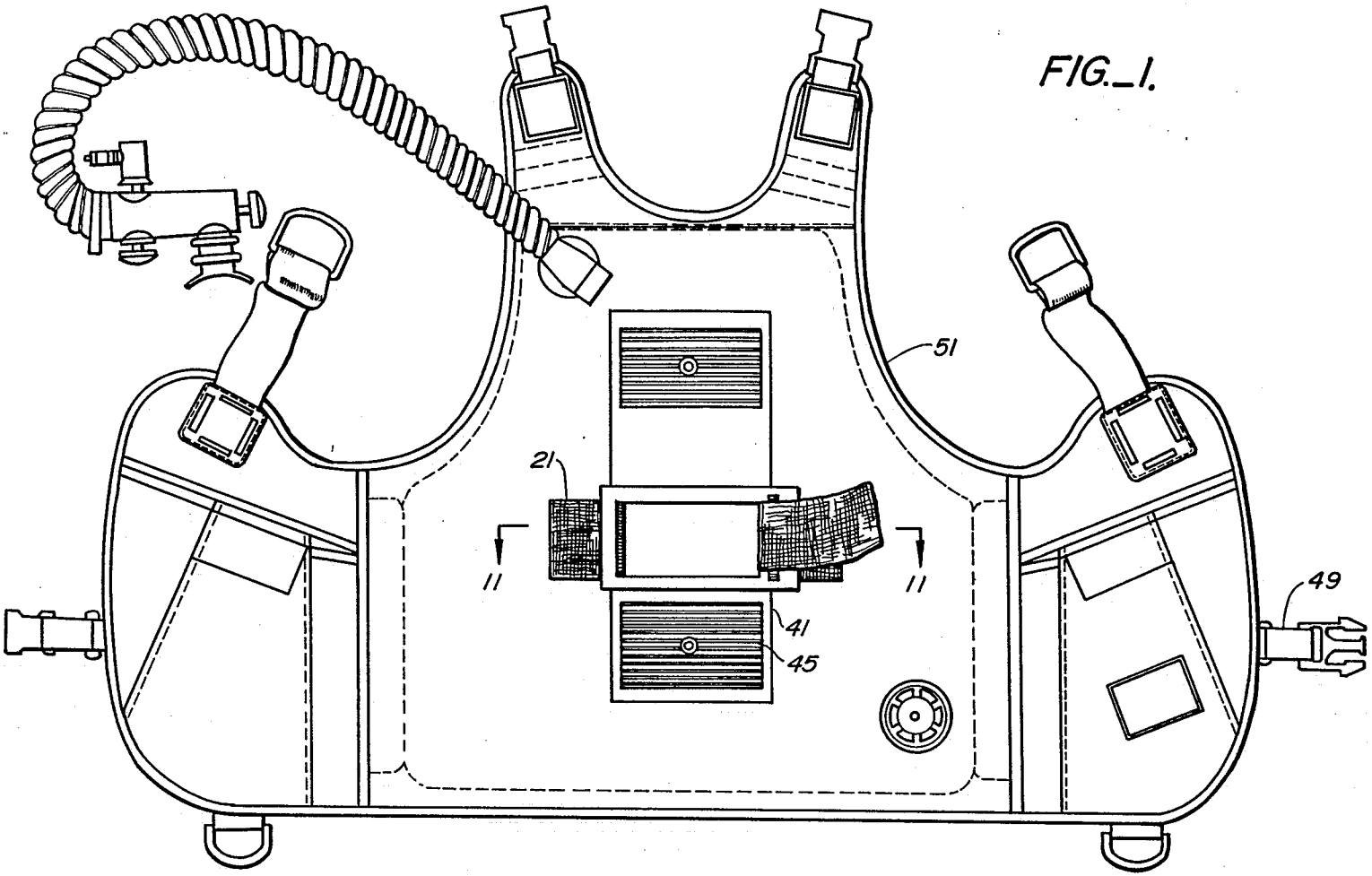
FIG. 1 is a front outside elevation of a SCUBA diver's buoyancy compensator vest for use with the present invention.
Figures 2, 3, 4, 5, 6, 7, 8, 9:
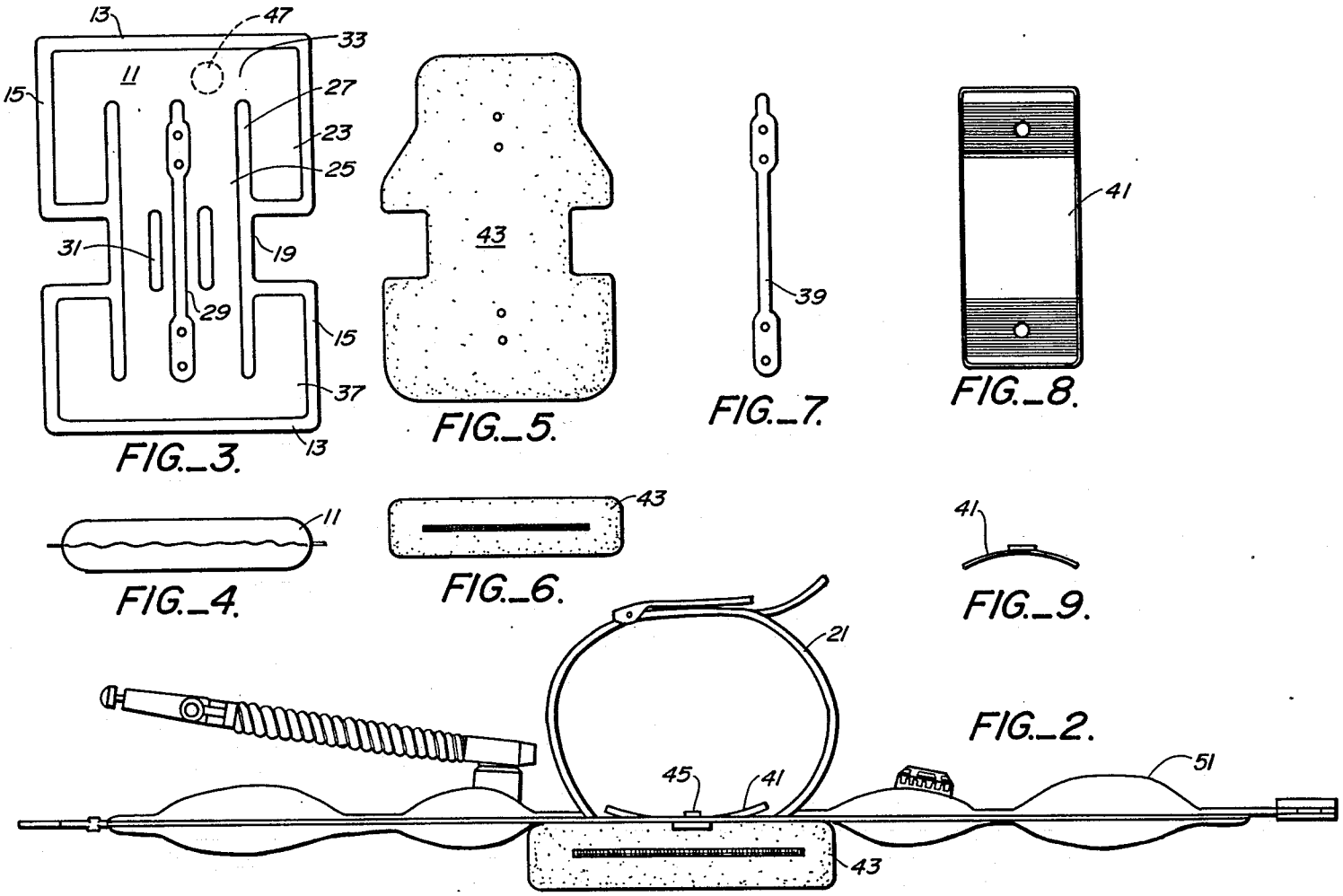
FIG. 2 is a top plan view of the vest of FIG. 2 showing the soft backpack of the present invention.
FIG. 3 is a front elevation of the bladder of the soft backpack of the present invention.
FIG. 4 is a top plan view of the bladder of FIG. 4.
FIG. 5 is a front elevation of a cover for the bladder of the present invention.
FIG. 6 is a top plan of the cover of FIG. 5.
FIG. 7 is a front elevation of a stiffener as used with the present invention.
FIG. 8 is a front elevation of the air tank mounting board as used with the present invention.
FIG. 9 is a top plan view of the mounting board of FIG. 8.
Figure 10:
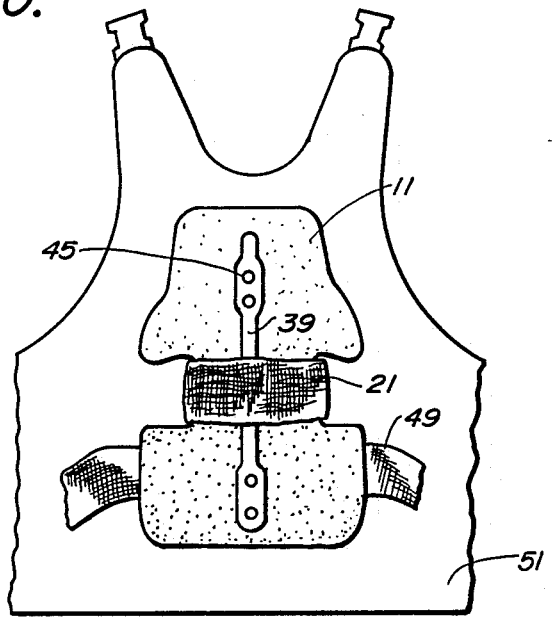
FIG. 10 is a partial rear inside elevation showing the belt which attaches the cover on the bladder of the present invention to the SCUBA diver's vest of FIG. 1.
Figure 11:
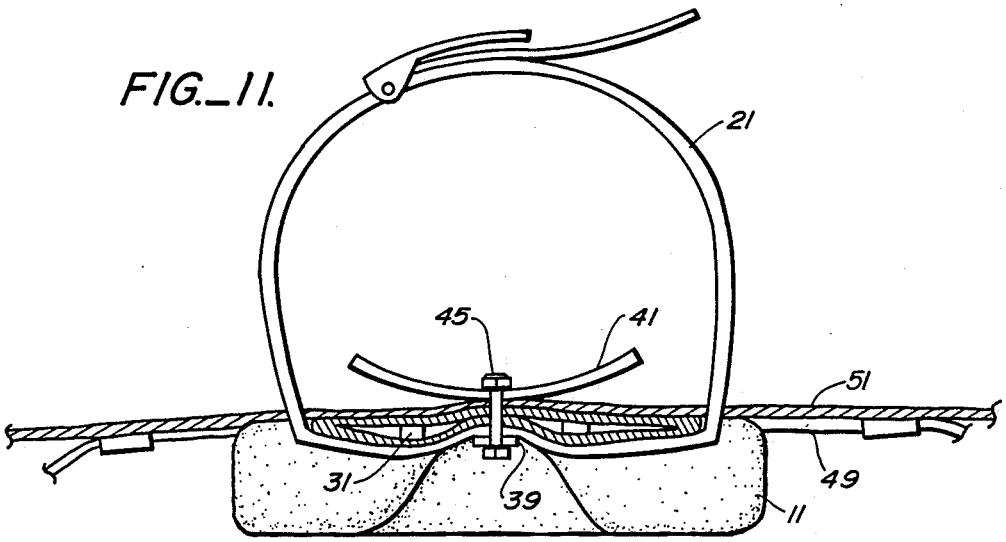
FIG. 11 is a partial top plan view in partial section showing the attachment of the air tank mounting strap to the bladder.

FIGS. 2, 3 and 4 show the bladder 11 of the preferred embodiment of the present invention. In its simplest form of construction, two pieces of plastic flexible material are joined together by heat welded seams with the outer lateral edges 13, 15 sealed together in a generally rectangular configuration. In operative position, the length of the rectangular bladder is oriented vertically with respect to the diver's back and aligned with the cylindrical configuration of the air tank.

A pair of side cuts 19 are formed in the bladder 11 to permit an air tank strap 21 to encircle both the bladder and the air tank and to hold the air tank to the bladder. A multiplicity of chambers 23, 25 are formed in the bladder essentially parallel to the vertical lateral edges 15 thereof. Some of these are formed by a pair of welds or seals 27 which are disposed parallel to vertical lateral edges thereof and are spaced inboard therefrom at the inboard ends of the side cuts 19 for a portion of the length of the lateral edges. A weld 29 is provided down the middle of the bladder parallel the pair of side welds 27 and is disposed between them. This forms essentially four parallel vertical chambers in which the two lateral or outer chambers 23 are interrupted intermediate their length to permit the tank strap to encircle the center portion of the bladder.

A pair of elongated riser welds 31 are provided in the middle of the bladder for the purpose of keeping a liquid communication channel open along their edges between the top and bottom chambers, 33, 37 respectively, so that the tank strap cannot compress the bladder and prevent the movement of fluid between the top and the bottom chambers of the bladder. The riser welds 31 include spacers or ribs (not shown) internally of the bladder to space the internal surfaces of the bladder apart adjacent the riser welds. The spacers are simply pieces of bladder material approximately ¼-inch thick which are configured the same as the riser welds.

A skeleton member or stiffener 39 is secured to the backside of the central weld 29 to provide backing for the tank mount plate 41. The tank mount plate is secured to the outside of the bladder 11 generally in the middle of the bladder while the skeleton 39 is secured to the opposite or backside with the bladder trapped between the skeleton and the tank mount plate 41.

In a preferred form, a cover 43 is provided which encloses the bladder to provide protection against abrasion. The stiffener or skeleton 39 can be mounted both inside or outside the cover. Fasteners 45 penetrate through the cover to secure the tank mount plate and the skeleton to the bladder.

A valve 47 is provided in the bladder 11 for changing or varying the volume of liquid in the bladder for comfort and to adjust for different weight air tank loads. The liquid can be one of any number of materials including water, gels, viscus fluids, etc., all of which have the characteristic of being at least initially slightly fluid to permit the backpack to adjust shape to the diver's configuration and to cradle the air tank. While a foam could be utilized to fill the bladder of the present invention, most foams are so low in density that they would add lift, which is one of the benefits of this invention, to eliminate as much lift as possible from the backpack by using a dense liquid to provide a neutral buoyancy for the liquid cushion. The liquids utilized would preferably remain in liquid form so as to be adaptable to different back configurations, but they could be a time setting plastic or gel which would become semi-rigid or rigid. While higher viscosity liquids would seem preferable for most divers because they would tend to dampen any movement of the tank on the diver's back, water will probably be most universally used.

A means is provided for securing the bladder to a SCUBA diver with the bladder disposed between the diver's back and the air tank. In its simplest form, the bladder could be provided with straps or a belt or secured to other hook-ons at the proper position on the diver's back. As an alternative, the bladder could be secured to or sewn into an over garment or jacket in form of a vest which in turn can be worn by the diver over a buoyancy compensator or removably or semi-permanently secured inside the buoyancy compensator. If the jacket is secured inside the buoyancy compensator 51, the straps for the tank would then have to be provided with means for passing through the buoyancy compensator. The bladder could be secured directly to a standard plastic backpack board, but in its most preferred embodiment, the soft backpack would most usually be an integral part of the buoyancy compensator mounted to the waist belt straps thereof 49.

An alternative form of the present invention would be to provide a larger skeleton member 39 for the soft pack which would possibly take the form of a fairly rigid board having liquid compartments formed thereon to provide the soft pack features of the present invention. In that configuration, the board would essentially be the tank mount and the pockets formed on the board would be the bladder portion thereof as set forth in the claims of this patent.

Thus, it will be seen from the description of the preferred embodiment that all of the objects and advantages of the invention are achieved. While the preferred embodiment of the invention has been described in considerable detail herein, the invention is not to be limited to such details as have been set forth except as may be necessitated by the appended claims.

I claim:

1. A soft backpack for at lease one SCUBA diver air tank comprising a flexible liquid-filled closed bladder means having an air tank mount secured thereto to provide a cushion to conform to a space between a SCUBA diver's back and said air tank, and means for securing the bladder means to a SCUBA diver with the bladder means disposed between the diver's back and the air tank.

2. The soft backpack of claim 1 wherein the bladder means has a skeleton member integral thereto which secures a tank mount to the bladder.

3. The soft backpack of claim 1 wherein the bladder means is secured to a diver's over garment.

4. The soft backpack of claim 1 wherein the bladder means contains a valve for changing the volume of liquid in the bladder.

5. The soft backpack of claim 1 wherein said bladder means is formed by two pieces of material sealed together around the edges including a pair of seals disposed parallel to the vertical lateral edges thereof and spaced inboard therefrom for a portion of the length of said lateral edges, and a seal disposed down the middle of the bladder means parallel said pair of seals and disposed there between also for a portion of the length of the lateral edges.

6. The soft backpack of claim 5 herein said bladder means includes a pair of riser welds disposed for positioning under the strap holding the air tank to the backpack to ensure that liquid channels are provided to allow liquid to continuously communicate between the top and bottom ends of said bladder means.

7. A soft backpack for SCUBA diver air tanks comprising a flexible liquid-filled bladder means which is disposed between a diver's back and his air tank to provide a cushion to conform to a space between a SCUBA diver's back and said air tank, said bladder means having side cuts formed therein to permit an air tank strap to encircle both the bladder means and an air tank to hold the air tank to the bladder means, said bladder means including a multiplicity of liquid chambers formed parallel to the lateral edges of said bladder means and means for permitting the liquid to move between the chambers formed above and below the location of the air tank strap, an air tank mount secured to said bladder means proximate the middle thereof, a valve for changing the volume of liquid in said bladder means, and means for securing the bladder means to a SCUBA diver with said bladder means disposed between the diver's back and the air tank.

8. The soft backpack of claim 7 wherein said bladder means is detachably secured to a garment which can be worn by the diver.

9. A soft backpack for SCUBA diver air tanks comprising a liquid filled bladder which is disposed between a diver's back and his air tank, said bladder being formed of two pieces of material sealed together around the peripheral edges and having a pair of side cuts formed therein to permit an air tank strap to encircle both an air tank and a portion of the width of the bladder to hold the air tank to the bladder, said bladder including additional seals spaced inboard therefrom and a seal disposed down the middle of the bladder parallel said pair of seals and disposed therebetween, said seals extending only for a portion of the length of said lateral edges, and a pair of spacers disposed between the interior surfaces of the bladder disposed adjacent to the side cuts in the bladder and under the air tank strap to prevent the strap from collapsing the bladder between the tank and strap and preventing liquid from communicating between the top and bottom ends of said bladder, a skeleton member secured to said bladder along said seal disposed down the middle of said bladder for securing an air tank mount to said bladder, and means for securing said bladder to a garment which can be worn by the diver.

* * * * *